US007159348B1

(12) United States Patent
Thomas et al.

(10) Patent No.: US 7,159,348 B1
(45) Date of Patent: Jan. 9, 2007

(54) SPORTS STICKITS

(76) Inventors: Sheere Thomas, 2436 W. Orange, Anaheim, CA (US) 92804; Patricia Porter, 2436 W. Orange, Anaheim, CA (US) 92804

( * ) Notice: Subject to any disclaimer, the term of this patent is extended or adjusted under 35 U.S.C. 154(b) by 222 days.

(21) Appl. No.: 10/421,923

(22) Filed: Apr. 24, 2003

Related U.S. Application Data

(60) Provisional application No. 60/375,079, filed on Apr. 25, 2002.

(51) Int. Cl.
*G09F 7/16* (2006.01)

(52) U.S. Cl. ..... 40/594; 40/595; D20/10; 63/14.9

(58) Field of Classification Search ..... 63/14.9, 63/DIG. 1; 40/594; 156/230; 428/138, 428/202
See application file for complete search history.

(56) References Cited

U.S. PATENT DOCUMENTS 1,140,975 A * 5/1915 Frankel ..... 2/1
1,300,592 A * 4/1919 Essig ..... 2/1
2,096,389 A * 10/1937 Bode ..... 428/42.2
2,665,510 A * 1/1954 Mitchell ..... 40/594
2,851,805 A * 9/1958 Allen ..... 132/319
3,601,917 A * 8/1971 Shankman ..... 40/622
4,419,396 A * 12/1983 Sugimoto ..... 428/40.2
5,107,868 A * 4/1992 Aryee ..... 132/201
5,233,845 A * 8/1993 D'Andrade ..... 63/14.9
5,279,132 A * 1/1994 Swaim ..... 63/3.1
5,561,932 A * 10/1996 Bracken ..... 40/638
5,811,108 A * 9/1998 Goeringer ..... 424/401
D447,278 S 8/2001 Amen-Ra
6,426,139 B1 * 7/2002 Ezra ..... 428/343

FOREIGN PATENT DOCUMENTS

JP 2003081701 A * 3/2003

* cited by examiner

*Primary Examiner*—Jack W. Lavinder
(74) *Attorney, Agent, or Firm*—Patent & Trademark Services, Inc; Joseph H. McGlynn

(57) ABSTRACT

A novelty item that can be applied to a person's skin and the item has a plurality of segments which are held in alignment by tabs.

12 Claims, 1 Drawing Sheet

SPORTS STICKITS

Applicant claims priority of Provisional Ser. No. 60/375,079, filed Apr. 25, 2002.

BACKGROUND OF THE INVENTION

This invention relates, in general, to a novelty item, and, in particular, to a novelty item that can be applied to a person's skin.

DESCRIPTION OF THE PRIOR ART

In the prior art various types of decorative personal items have been proposed. For example, U.S. Pat. No. D447,278 to Amen-Ra discloses a design for an eyelash appliqué having spaced gems attached to a strip.

U.S. Pat. No. 5,279,132 to Swain discloses a holding device for holding a necklace in position on a person's neck.

U.S. Pat. No. 5,233,845 to D'Andrade discloses three dimensional jewelry that can be worn directly on a person's body.

U.S. Pat. No. 1,140,975 to Frankel discloses a beauty mark that can be applied directly to a person's face.

SUMMARY OF THE INVENTION

The present invention is directed to a novelty item that can be applied to a person's skin.

It is an object of the present invention to provide a new and improved novelty item that can be easily applied to a person's skin.

It is an object of the present invention to provide a new and improved novelty item comprising plural parts that can be easily applied to a person's skin without rearranging each individual part.

It is an object of the present invention to provide a new and improved novelty item that can be easily applied to a person's skin and that is inexpensive to produce and can be produce in a variety of shapes.

These and other objects and advantages of the present invention will be fully apparent from the following description, when taken in connection with the annexed drawings.

DESCRIPTION OF THE PREFERRED EMBODIMENT

Figure 1:
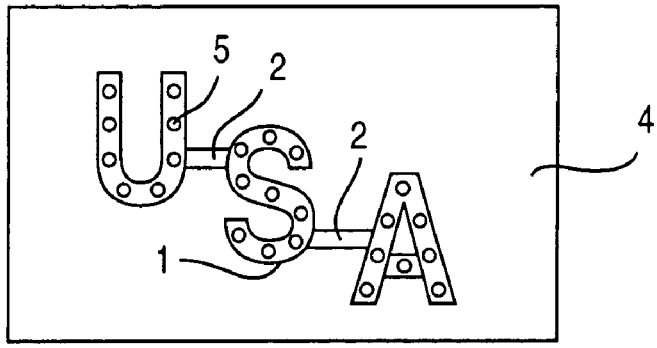
FIG. 1 is a plan view of the present invention.

Referring now to the drawings in greater detail, FIG. 1 shows a plan view of the present invention which has a backer sheet 4 on which decorative items or segments 1, 5 are placed. The decorative items can assume a variety of shapes. For example in FIG. 1, they are the letters "U S A" with a plurality of jewel-like objects 5 attached to the letters in any conventional manner. The letters could be in different colors and the jewel-like objects could also be in different colors to provide a pleasing and eye-catching appearance. It should be noted that while the letters "USA" are shown in the drawing other letters could be used without departing from the scope of the invention. For example, the letters of a person's school or the person's initials could be used instead of the letters "USA".

In order to hold the letters 1 to the backing sheet 4 an adhesive is used which will secure the letters to the backing sheet, but at the same time allow the letters to be easily removed from the backing sheet without damaging the letters 1.

In addition, the glue used to secure the letters 1 to the backing sheet 4 must allow the letters 1 to be easily secured to a person's face.

The problem with using individual letters, such as the letters "USA" is, once they are removed from the backing sheet 4 they are difficult to apply to a person's face in the same arrangement as they appear on the backing sheet, which sometimes destroys the overall appearance of the item. At the same time if the letters are all connected together on a single sheet, which is then applied to the backing sheet, the user has no control over the placement of the letters. That is, a user will sometime want to arrange the letters slightly differently when they are applied to their face.

In order to solve this problem, joining tabs 2 are applied between the letters 1 as shown in FIG. 1. The tabs 2 should be transparent so they will not be noticeable when applied to a person's face, which would ruin the aesthetic quality of the design. Also, the tabs 2 should be slightly flexible so there will be some degree of flexibility between the tabs 2 and the letters 1. This will allow the user flexibility in arranging the letters, however, the user will not have to go through the time consuming procedure of arranging each letter individually, as they would if there where no tabs between the individual letters.

Figure 2:
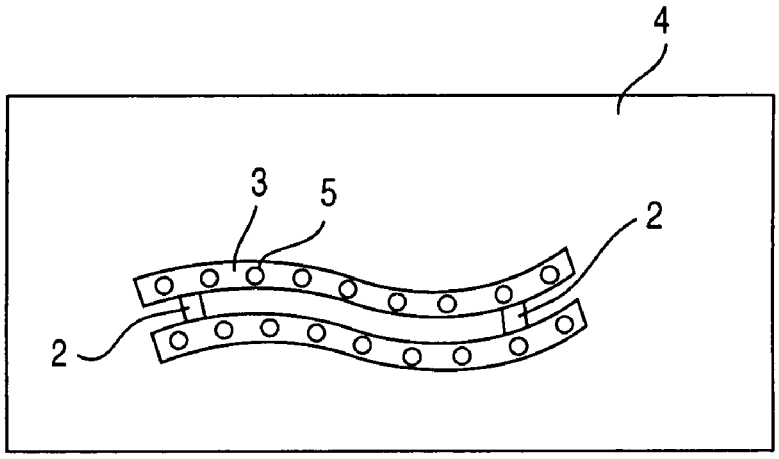
FIG. 2 is a plan view of a second embodiment of the present invention.

As shown in FIG. 2, the invention does not need to use letters such as the letters 1. In FIG. 2 a pair of wave-like lines 3 are used. Again, jewel-like devices 5 are applied to the FIG. 2 device similar to the FIG. 1 device, and tabs 2 are secured between the wave-like lines 3. Again, the same backer sheet 4 is used (as in the FIG. 1 device).

Figure 3:
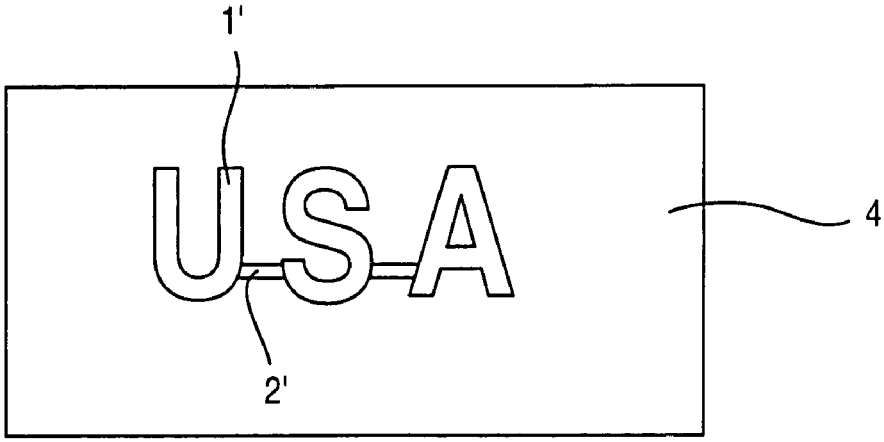
FIG. 3 is a plan view of a third embodiment of the present invention.

In FIG. 3, a third embodiment is shown. In this embodiment the backer sheet 4 is used, just as in the FIG. 1 and FIG. 2 embodiments, however, no jewel-like devices are applied to the letters, and the letters 1' are arranged in a more or less straight line, although other arrangements could be used without departing from the scope of the invention. The letters could be made in different colors, or each letter could be made in a plurality of colors. In all other aspects, the FIG. 3 device is made and used in the same manner as the FIG. 1 and FIG. 2 devices.

Although the Sports Stickits and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

We claim:

1. A novelty item adapted to be applied to a body part, said novelty item comprising:

a backer sheet, said backer sheet having a length, width and a thickness, and said backer sheet having sides and a front surface and a back surface, at least three segments attached to said front surface, wherein said segments are letters, and said letters are spaced apart from each other by a plurality of tabs, each set of two adjacent letters in the novelty item having at least one tab with a first end secured to one letter and a second opposed end secured to the other letter so that no portion of one letter touches another letter.

2. The novelty item as claimed in claim 1, wherein said letters have ornamental items secured thereto.

3. The novelty item as claimed in claim 1, wherein said plurality of segments are secured to said front surface by an adhesive.

4. The novelty item as claimed in claim 3, wherein said adhesive is a releasable adhesive which allows said plurality of segments to be removed from said front surface.

5. The novelty item as claimed in claim 1, wherein said tabs are flexible.

6. The novelty item as claimed in claim 5, wherein said letters have ornamental items secured thereto.

7. The novelty item as claimed in claim 5, wherein said plurality of segments are secured to said front surface by an adhesive.

8. The novelty item as claimed in claim 7, wherein said adhesive is a releasable adhesive which allows said plurality of segments to be removed from said front surface.

9. The novelty item as claimed in claim 1, wherein said tabs are transparent.

10. A novelty item adapted to be applied to a body part, said novelty item comprising:

a backer sheet, said backer sheet having a length, width and a thickness, and said backer sheet having sides and a front surface and a back surface, at least three segments attached to said front surface, wherein said segments are letters, and said letters are spaced apart from each other by a plurality of tabs, each set of two adjacent letters in the novelty item having at least one tab with a first end secured to one letter and a second opposed end secured to the other letter so that no portion of one letter touches another letter, and said first end of each said tab does not extend beyond a boundary of one of said letters, and said second end of each said tab does not extend beyond a boundary of said adjacent letter.

11. The novelty item as claimed in claim 10, wherein said tabs are flexible.

12. The novelty item as claimed in claim 10, wherein said tabs are transparent.

* * * * *